US009488445B2

(12) United States Patent
Houde-Walter

(10) Patent No.: US 9,488,445 B2
(45) **Date of Patent: *Nov. 8, 2016**

(54) FIREARM MOUNT WITH EMBEDDED SIGHT

(71) Applicant: LaserMax, Inc., Rochester, NY (US)

(72) Inventor: William R. Houde-Walter, Rush, NY (US)

(73) Assignee: LaserMax, Inc., Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/203,534

(22) Filed: Mar. 10, 2014

(65) Prior Publication Data

US 2015/0007481 A1 Jan. 8, 2015

Related U.S. Application Data

(60) Division of application No. 12/824,799, filed on Jun. 28, 2010, now Pat. No. 8,695,267, which is a continuation-in-part of application No. 12/118,105, filed on May 9, 2008, now Pat. No. 7,743,547, which is a division of application No. 11/307,385, filed on Feb. 4, 2006, now Pat. No. 7,421,818.

(51) Int. Cl.

| | |
|---|---|
| ***F41G 1/34*** | (2006.01) |
| ***F41C 27/00*** | (2006.01) |
| ***F41G 1/35*** | (2006.01) |
| ***F41G 11/00*** | (2006.01) |
| ***F41G 1/36*** | (2006.01) |

(52) U.S. Cl.

CPC ..... *F41G 11/003* (2013.01); *F41G 1/35* (2013.01); *F41G 1/36* (2013.01)

(58) Field of Classification Search

CPC ..... F41G 1/32; F41G 1/34; F41G 1/35; F41G 1/36; F41G 11/003

USPC ..... 42/84, 90, 114, 115, 117, 146

See application file for complete search history.

(56) References Cited

U.S. PATENT DOCUMENTS

| | | | | |
|---|---|---|---|---|
| 4,841,659 A | | 6/1989 | Williams | |
| 4,934,086 A | * | 6/1990 | Houde-Walter | 42/115 |
| 5,375,362 A | * | 12/1994 | McGarry et al. | 42/117 |
| 6,295,754 B1 | | 10/2001 | Otteman et al. | |

(Continued)

FOREIGN PATENT DOCUMENTS

CN 2731764Y B 10/2005

OTHER PUBLICATIONS

Laserlyte a Division of P&L Industries, 2005 Catalog, Catalog 05-1 Cover & pp. SM00057-SM00061; LaserlyteQD shown on p. SM00060; Laserlyte, a Division of P&L Industries.

(Continued)

*Primary Examiner* — Bret Hayes

(74) *Attorney, Agent, or Firm* — Brian Shaw; Roland R. Schindler II; Harter, Secrest & Emery

(57) ABSTRACT

A laser sight is embedded in a mounting rail otherwise used for attaching accessories to small arms discharge devices such as pistols or rifles. The mounting rail has a transverse profile that extends along an axis of the mounting rail for engaging mating features of the accessories. The laser sight is located at least partly within the transverse profile of the mounting rail and has a sighting axis that extends substantially parallel to the axis of the mounting rail.

2 Claims, 16 Drawing Sheets

(56) References Cited

U.S. PATENT DOCUMENTS

| | | | | |
|---|---|---|---|---|
| 6,513,251 | B2 | 2/2003 | Huang et al. | |
| 6,606,813 | B1 * | 8/2003 | Squire et al. | 42/90 |
| 7,188,978 | B2 | 3/2007 | Sharrah et al. | |
| 7,421,818 | B2 * | 9/2008 | Houde-Walter | 42/146 |
| 7,726,061 | B1 | 6/2010 | Thummel | |
| 7,743,547 | B2 * | 6/2010 | Houde-Walter | 42/146 |
| 8,413,362 | B2 * | 4/2013 | Houde-Walter | 42/84 |
| 8,695,267 | B2 * | 4/2014 | Houde-Walter | 42/146 |
| 2004/0000083 | A1 | 1/2004 | Grant, Jr. | |
| 2005/0268519 | A1 | 12/2005 | Pikielny | |
| 2011/0162514 | A1 * | 7/2011 | Osborne et al. | 89/27.12 |

OTHER PUBLICATIONS

Defendant Sellmark Corporation's Initial Invalidity Contentions; filed in the United States District Court for the District of Delaware; Civil Action No. 1:14-cv-00740-LPS; May 18, 2015; Sellmark Corporation.

Exhibit a to Defendant Sellmark Corporation's Initial Invalidity Contentions, filed Jul. 1, 2015, USDC DE, Civil Action 1o. 1:14-cv-00740-Lps; Sellmark Corporation.

Exhibit B to Defendant Sellmark Corporation's Initial Invalidity Contentions, filed Jul. 1, 2015, USDC DE, Civil Action No. 1:14-cv-00740-LPS; Sellmark Corporation.

Exhibit C to Defendant Sellmark Corporation's Initial Invalidity Contentions, filed Jul. 1, 2015, USDC DE, Civil Action No. 1:14-cv-00740-LPS; Sellmark Corporation.

Defendant's Initial Claim Terms for Construction and Proposed Constructions, filed in the United States District Court for the District of Delaware; Civil Action No. 1:14-cv-00740-LPS; May 22, 2015; Sellmark Corporation.

Plaintiff's Initial Claim Terms for Construction and Proposed Constructions; filed in the United States District Court for be District of Delaware; Civil Action No. 1:14-cv-00740-LPS; May 22, 2015; Lasermax, Inc.

Rauch, W. "Combat Test: New Sigarms P229KDA0.40." Combat Handguns, Feb. 2004, pp. 10 - 15.

Boyle, M."Combat Test: Springfield XD4OS&W Tactical Pro." Combat Handguns, Feb. 2004, pp. 54-59.

Fortier, D. "Quartermaster: Laserlyte Qd Laser System" Guns Magazine, Nov. 2003, pp. 14.

Da dated May 15, 2013 in corresponding Chinese Application No. 200780010235.7 along with an English translation/summary.

Da dated Sep. 27, 2013 in corresponding Chinese Application No. 200780010235.7 along with an English translation/summary.

* cited by examiner

FIREARM MOUNT WITH EMBEDDED SIGHT

CROSS-REFERENCE TO RELATED APPLICATIONS

The present application is a continuation of U.S. application Ser. No. 12/824,799 filed Jun. 28, 2010 published as U.S. Published Patent application 2011/0162251 and issuing on Apr. 15, 2014 as U.S. Pat. No. 8,695,267 which is a continuation in part of U.S. application Ser. No. 12/118,105 filed May 9, 2008, published as U.S. Published Patent application 2009/0013580 and issuing on Jun. 29, 2010 as U.S. Pat. No. 7,743,547, which is a division of U.S. application Ser. No. 11/307,385 filed Feb. 4, 2006 published as U.S. Published Patent application 2007/0170752 and issuing as U.S. Pat. No. 7,421,818 on Sep. 9, 2008 each of which is expressly incorporated by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING"

Not applicable.

BACKGROUND OF THE INVENTION

1. Field of the Invention

The present invention relates to sights and their mounting on small arm dischargeable devices such as firearms.

2. Background of the Invention

Laser sights are particularly effective as sighting devices because the lasers illuminate spots on their targets and do not require users to align an eye with a sighting device, which can limit or obscure the user's view of the targets or their surroundings. When mounted on firearms, the laser sights emit beams that are directed along the expected flight paths of projectiles discharged from the firearms. However, the laser sights are necessarily mounted offset from the firearm barrels, so the laser beams extend generally parallel but offset from the initial flight paths of the projectiles. At close distances, the offset can result in a significant targeting error approximating the initial offset. Small angular adjustments of the laser sights can compensate for the offset at longer distances.

Particularly for handguns, which are intended for targeting over shorter distances, reducing the amount of this offset is desirable. My earlier U.S. Pat. No. 4,934,086 describes mounting a laser sight within the recoil spring tube of a firearm. The spring tube mounting locates the laser sight close to the barrel, protects the laser sight from exposure to external jarring, and avoids the encumbrance of an external accessory. However, such built-in mounting locations are not available in all handguns, so laser sights have also been externally mounted from both conventional rails and special adapters.

Both the accessory mounts presented on firearms and the receptors for engaging them tend to offset the laser sights from the barrels. Alternative adapter structures used for attaching laser sights to firearm components that are not otherwise arranged as mountings also tend to offset the laser sights from firearm barrels. Among the accessory mounts, rail mounts, such as Picatinny rails, offset laser sights by the space occupied by the rails themselves and any attachments for fixing the rails to the firearm barrels or frames. In addition, the receptors used for engaging the rails can take up more space and displace the laser sights farther from firearm barrels. The known laser sight modules mounted in this way are also exposed to jarring and can encumber the handling or operation of firearms, particularly as the laser sights are mounted at increasing offset from firearm barrels.

BRIEF SUMMARY OF THE INVENTION

In one configuration, the present system exploits space occupied by accessory mounts to construct sub-mountings for laser sights for such purposes as minimizing the offset of the laser sights from barrels, protecting the laser sights from exposure to jarring, and reducing encumbrances presented by the laser sights to the safe handling and operation of firearms. The accessory mounts, which present rails or other features for mounting accessories, can be integral parts of the firearms or can be attached as appendages to the firearms. The laser sights are preferably embedded within the accessory mounts without interfering with their function as primary or secondary mounts for attaching accessories to the firearms and also preferably without increasing the size of the accessory mounts.

In other words, the present system can exploit space otherwise occupied by the accessory mounts to locate the laser sights or other functional devices closer to barrels, particularly within protected spaces having a reduced external profile with respect to the profile of laser sights mounted as conventional accessories. The accessory mounts within which the laser sights are embedded provide primary or secondary mounts for other accessories for appending or enhancing other functionalities. In addition to conventional firearms, the present system is applicable to other small arm dischargeable devices including air guns, paintball launchers, crossbows, and other small arms that benefit from targeting.

In one version, an adapter mounting rail is provided to operably engage a conventional dovetail receptor of the accessory. The adapter mounting rail has tapered sidewalls that (a) extend along a longitudinal axis of the adapter mounting rail and (b) are spaced apart along an orthogonal transverse axis of the adapter mounting rail in positions for engaging mating sidewalls of a dovetail receptor formed in an accessory. However, in contrast to conventional accessory mounts, the present adapter can include a laser sight substantially aligned with the longitudinal axis of the adapter mounting rail.

In one configuration, the laser sight is located between the tapered sidewalls along the transverse axis of the adapter mounting rail. The tapered sidewalls of the adapter mounting rail can have opposing V-shaped profiles with apices aligned along the transverse axis. The laser sight preferably includes a beam generator and a collimating optic aligned by a common housing.

The tapered sidewalls of the adapter mounting rail overhang opposing sides of a spacer or pedestal that supports the tapered sidewalls. The laser sight can be located (i) entirely embedded in the space between the tapered sidewalls of the adapter mounting rail; (ii) within the spacer; or (iii) partially located in the spacer and the adapter mounting rail.

The adapter mounting rail can be formed integrally with the small arm dischargeable device or can be attached to the dischargeable device by a clamp or other fastener. The adapter mounting rail can also be formed as a part of an adapter that presents the adapter mounting rail as a secondary mount and has an adapter receptor for engaging the primary mount on the dischargeable device. For example, the adapter receptor can be formed as a dovetail receptor for engaging a primary rail mount of or attached to the small arm dischargeable device as the primary mount.

An outer land surface of the adapter mounting rail can interconnect the tapered sidewalls. A battery compartment for supplying power to the laser sight can be formed in the adapter mounting rail through the outer land surface. A repositionable cover for the battery compartment can form a portion of the outer land surface of the adapter mounting rail.

It is understood the adapter receptor and the adapter mounting rail can have any of a variety of specific cross sectional profiles, and thereby encompass dovetail constructions such as Picatinny and Weaver style.

Thus, the present system includes the adapter for mounting an accessory relative to a small arm dischargeable device, wherein the adapter includes an adapter body having an adapter receptor and an adapter mounting rail spaced from the adapter receptor. The adapter mounting rail has a transverse profile extending along an axis of the mounting rail for engaging mating features of the accessory, wherein the adapter mounting rail can be spaced from the body by a spacer which forms a pedestal. The adapter receptor is adaptable to the dischargeable device for aligning the axis of the adapter mounting rail substantially parallel with a discharge axis of the dischargeable device. A light-emitting sighting device is located at least partly within the transverse profile of at least one of the adapter mounting rail and the spacer and has a sighting axis that extends substantially parallel to the axis of the adapter mounting rail.

In one configuration, the transverse profile of the adapter mounting rail is formed in part by relatively inclined sidewalls of the adapter mounting rail, and the light-emitting sighting device is located between the relatively inclined sidewalls of the adapter mounting rail. A battery compartment for powering the light-emitting sighting device can also be formed in the adapter mounting rail. A cover for the battery compartment preferably encloses the battery compartment within the adapter mounting rail.

In the adapter mounting rail, the transverse profile is formed in part by an outer land surface, and the outer land surface of the adapter mounting rail includes at least one recoil groove that extends substantially perpendicular to the axis of the mounting rail.

The adapter receptor can be formed integrally with the adapter body or can be formed as a clamp for attaching directly to the adapter body. For example, the clamp can include mating features for engaging a barrel or frame of the small arm dischargeable device. Alternatively, the clamp can include mating features in the form of the receptor for engaging a mounting rail of the small arm dischargeable device.

BRIEF DESCRIPTION OF THE SEVERAL VIEWS OF THE DRAWING(S)

DETAILED DESCRIPTION OF THE INVENTION

Figure 1:
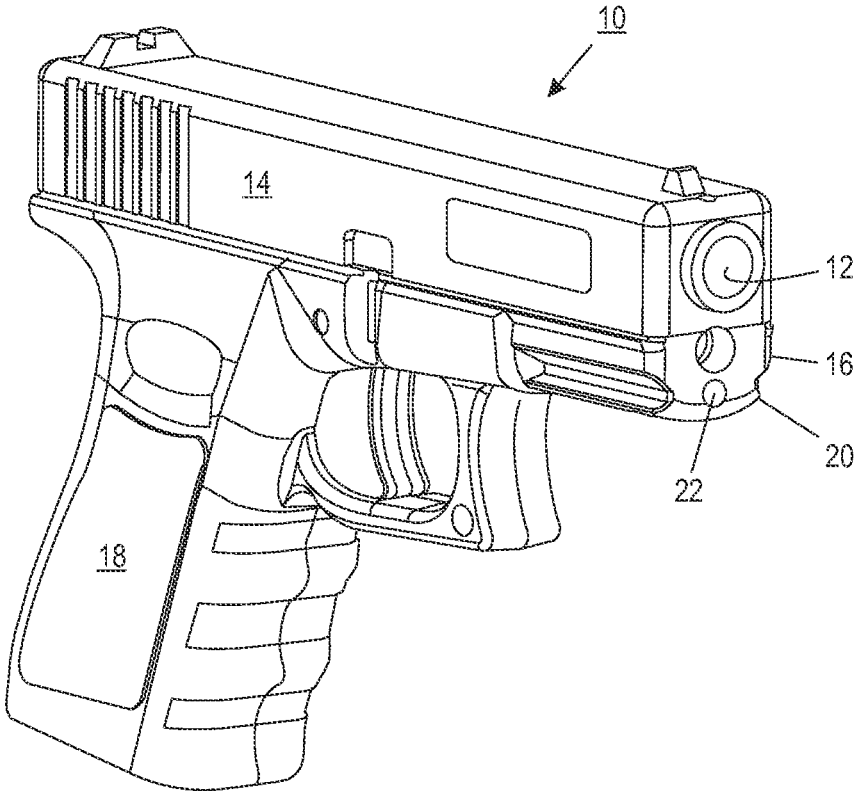
FIG. 1 is a perspective view of a pistol having a laser sight embedded in a mounting rail formed integrally with a receiver of the pistol.

A small arm dischargeable device, such as a conventional pistol 10 is depicted in FIG. 1, includes the usual features of a barrel 12, a slide 14, and a receiver (or frame) 16 with an integral grip 18 as well as an accessory rail mount 20 such as a primary rail mount which can have any of a variety of configurations such as Picatinny or Weaver. The accessory rail mount 20 extends along a discharge axis of the small arm dischargeable device.

Figure 2:
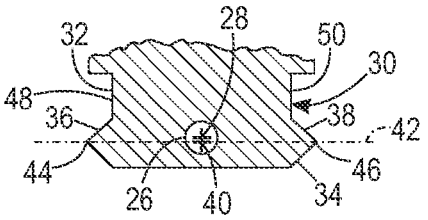
FIG. 2 is an enlarged cross-sectional end view of a Picatinny rail in transverse profile showing a laser sight embedded in a platform portion of the mounting rail.
Figure 3:
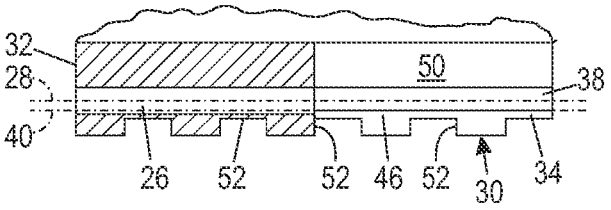
FIG. 3 is an enlarged partly cutaway portion of the mounting rail showing the embedded laser sight aligned substantially parallel to a longitudinal axis of the mounting rail.

Referring to FIGS. 2 and 3, an alternative primary rail mount 30 is shown having the conventional configuration of a rail mount with a generally T-shaped profile, thus providing a dovetail such as a Weaver or Picatinny rail. A pedestal 32 (forming the base of the T) supports an overhanging platform 34 (forming the crossbar of the T) that has tapered sidewalls 36 and 38 extending without interruption along a longitudinal axis 40 of the primary rail mount 30. The longitudinal axis 40 is generally aligned with a barrel of a firearm. The tapered sidewalls 36 and 38, which are spaced apart along an orthogonal transverse axis 42 of the primary rail mount 30, are formed as compound surfaces having opposing V-shaped profiles with apices 44 and 46 aligned along the transverse axis 42. The V-shaped profiles of the tapered sidewalls 36 and 38 are engageable by mating surfaces of receptors (not shown) for attaching accessories to the primary rail mount 30. Sides 48 and 50 of the pedestal 32 provide clearance for engaging the receptors.

The laser sight 26, which is embedded within the platform 34 of the primary rail mount 30, occupies a space between the tapered sidewalls 36 and 38 of the platform 34 that would otherwise form a solid part of the primary rail mount 30 or a recess within the primary rail mount 30. The laser sight 26 has an optical axis 28 that is substantially aligned with the longitudinal axis 40 of the primary rail mount 30, but is also preferably adjustable to secure a desired alignment with the discharge axis of the firearm or other discharge device on which the laser sight 26 is mounted. In addition, the laser sight 26 is can be centered between the tapered sidewalls 36 and 38 along the transverse axis 42. The primary rail mount 30 also includes at least one recoil groove 52 that crosses the primary rail mount 30 in the direction of the transverse axis 42. It is understood the primary rail mount 30 can include a set of recoil grooves 52 extending along the transverse axis 42. The laser sight 26 is preferably mounted beneath the recoil grooves 52 to limit environmental exposure or to avoid interfering with any intended functions for the recoil grooves 52.

Figure 4:
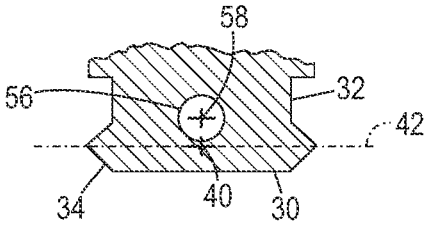
FIG. 4 is an enlarged cross-sectional end view of the same Picatinny rail in a transverse profile showing a larger laser sight embedded in parts of both the platform portion of the mounting rail and a pedestal portion of the mounting rail.
Figure 5:
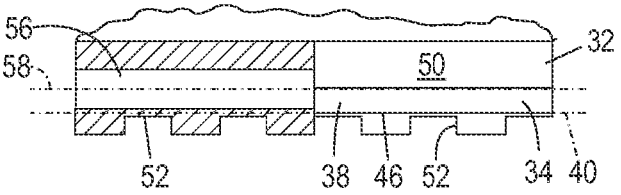
FIG. 5 is an enlarged partly cutaway portion of the same mounting rail showing the embedded larger laser sight aligned substantially parallel to a longitudinal axis of the mounting rail.

FIGS. 4 and 5 show a different location for embedding a larger laser sight 56 within the same primary rail mount 30. Instead of embedding the laser sight 56 entirely within the platform 34 of the primary rail mount 30 as depicted in FIGS. 2 and 3, the laser sight 56 of FIGS. 4 and 5 is embedded partly within the platform 34 and partly within the pedestal 32. The additional space provided by the platform 34 allows the larger laser sight 56 to be embedded within the primary rail mount 30 without protruding into the recoil groove(s) 52.

The laser sight 56 has an optical axis 58 that is substantially aligned with the longitudinal axis 40 and is also preferably adjustable for perfecting the alignment of the optical axis 58 with the expected flight path of a projectile or other emission discharged from a small arm dischargeable device on which the laser sight 56 is mounted. The laser sight 56 is also centered along the transverse axis 42 between the sidewalls 36 and 38 of the platform 34.

Thus, space within the entire T-shaped profile of the primary rail mount 30 can be used for embedding a laser sight such as the laser sights 26 and 56. This allows the laser sights 26 and 56 to be mounted within a protected environment closer to the discharge axes of small arms without taking up additional space or creating unnecessary encumbrances. While the system is expected to be especially useful as a modification to Picatinny rails, other mounting rails, particularly those of the Picatinny type that differ in size or shape but present a comparable dovetail mounting system with transverse space sufficient for embedding a laser sight, can also benefit from the invention.

Figure 6:
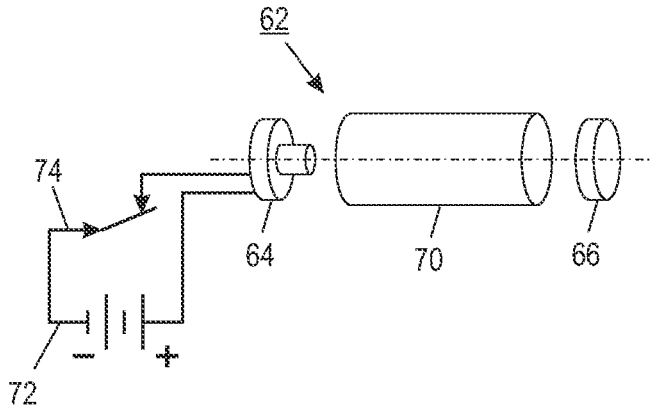
FIG. 6 is an enlarged partly exploded view of a laser sight assembly within a common tubular housing and connected to a portable power supply.
Figure 7:
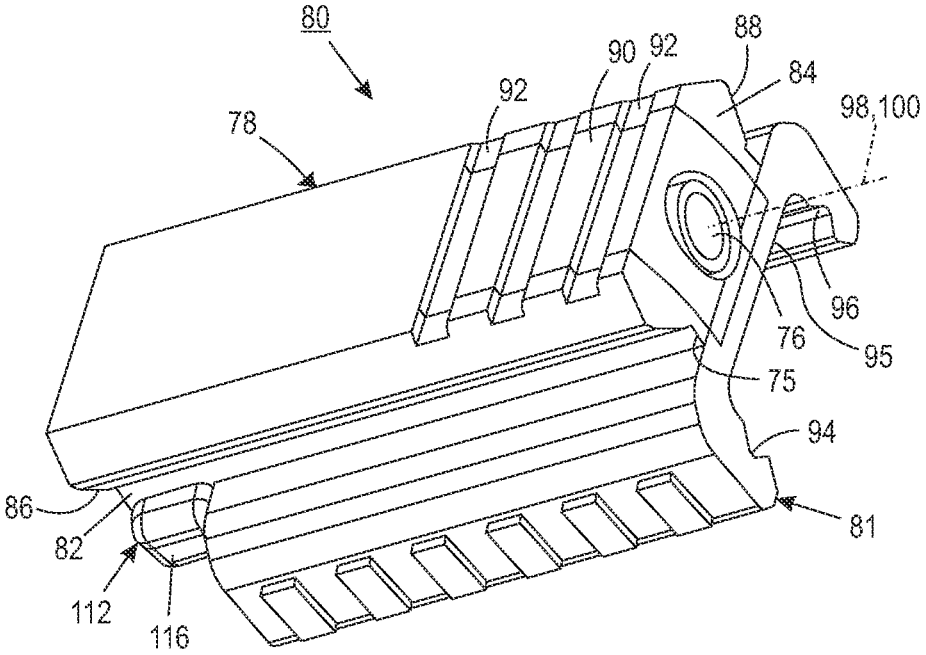
FIG. 7 is an enlarged perspective view of an adapter having a mounting rail and a receptor with a laser sight embedded within the mounting rail.
Figure 8:
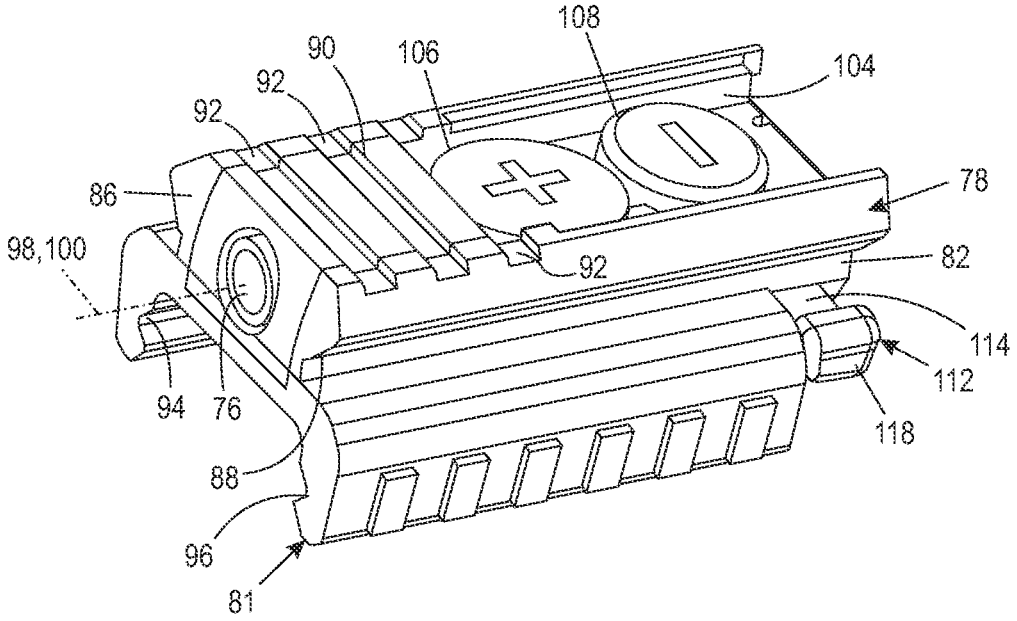
FIG. 8 is an opposite side perspective view of the adapter showing a battery compartment formed in the mounting rail for powering the laser sight.
Figure 9:
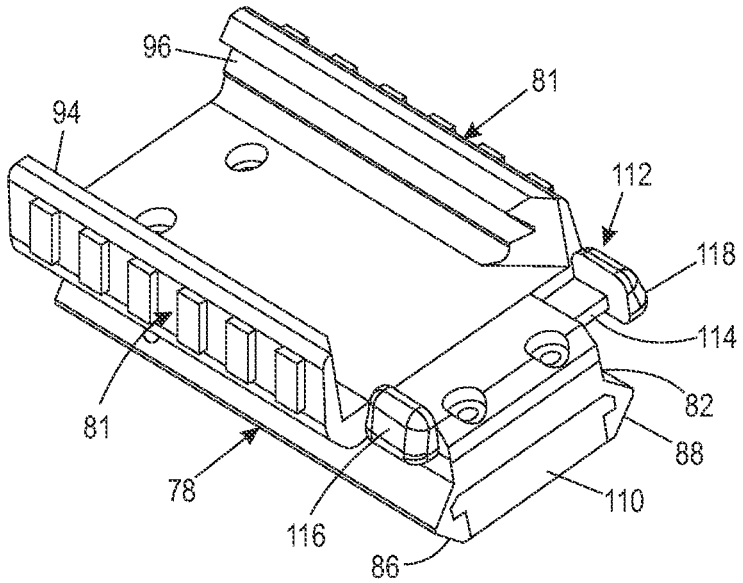
FIG. 9 is an inverted perspective view of the adapter showing details of the receptor and a toggle switch for turning the laser sight on and off.
Figure 10:
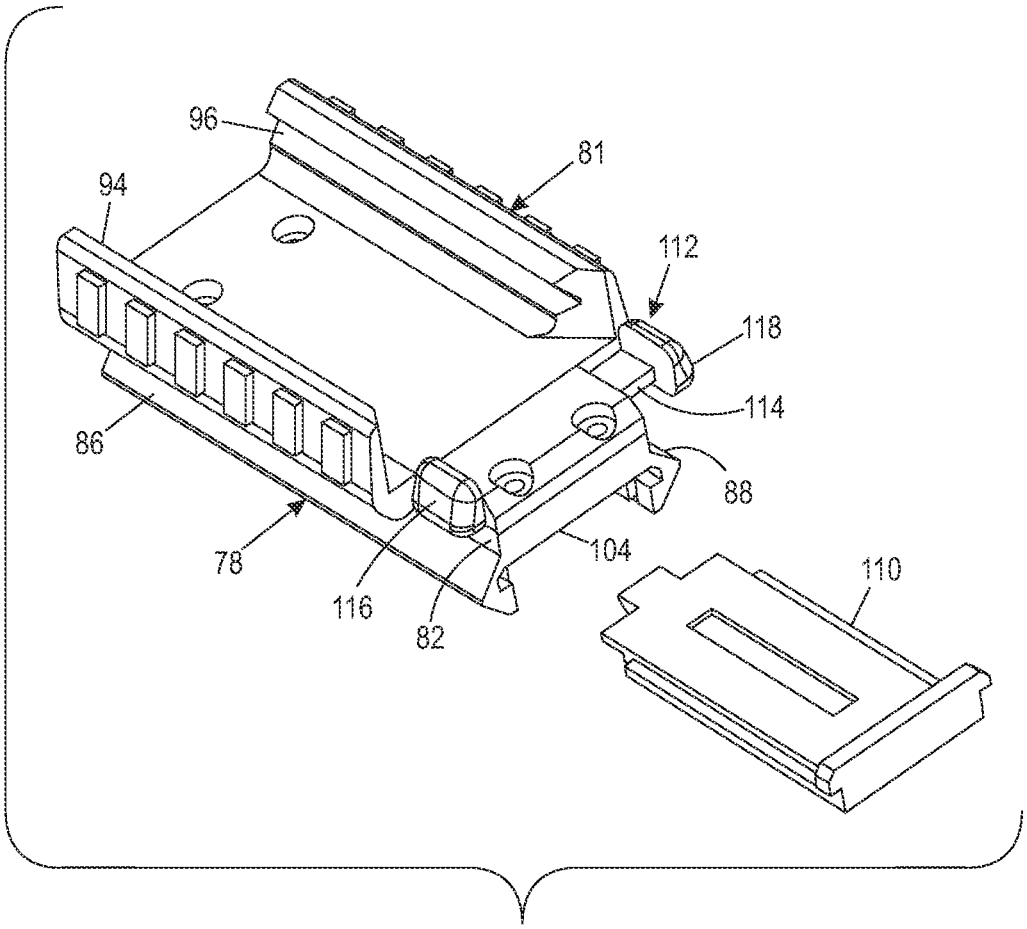
FIG. 10 is another inverted perspective view showing a cover withdrawn from the battery compartment.

As shown in FIG. 6, a typical laser sight 62 intended for purposes of the present system includes a laser diode 64 and a collimating lens 66 aligned along a common optical axis 68 within a common housing 70. Additional components can also be included within the housing including control circuitry (not shown) for cycling the laser diode 64 on and off to save power and adjustment features for the collimating lens for aligning the laser sight 52 as desired. An onboard power supply 72 supplies power to the laser diode 36 through a circuit interrupted by a switch 74. The power supply 72, which is preferably in the form of one or more batteries, can be located within an extension of the common housing 70 or can be located elsewhere in the primary rail mount or within the small-arm discharge device, such as within the grip of a firearm. The switch 74 can also be mounted in the primary rail mount or elsewhere in the small-arm discharge device. A more detailed example of a laser sight that can be assembled within a common housing is described in my U.S. Pat. No. 5,509,226, which is hereby incorporated by reference.

Another embodiment is depicted in FIGS. 7-10 provides an adapter 80 which cooperatively engages the small arm dischargeable device, such as the pistol 10.

Generally, the adapter 80 includes an adapter receptor 81, an adapter mounting rail 78 spaced from the adapter receptor and an adapter body 75 sized to encompass the adapter receptor. Generally, the adapter receptor 81 functions as a female mount and the adapter mounting rail 78 functions as a male mount. It is understood the adapter mounting rail 78 can be of substantially the same configuration as the primary rail mount 30.

The adapter body supports the adapter receptor and the adapter mounting rail. In one configuration, at least a portion of the adapter body, the adapter receptor, and the adapter mounting rail are a one piece construction, wherein selected portions such as covers, switches, or electrical components may be separately attached.

Generally, the adapter receptor and the adapter mounting rail include the mating features of mounting rails including primary rail mounts such as the Weaver or Picatinny type.

The adapter mounting rail 78 and the adapter receptor 81 include the mating features of dovetail joints, preferably of the Picatinny type. For example, the adapter mounting rail 78 has a T-shaped profile with a pedestal, or spacer, 82 supporting an overhanging platform 84. Sidewalls 86 and 88 of the platform 84 have compound surfaces with opposing V-shapes for engaging similarly shaped sidewalls in an accessory receptor (not shown). An outer land surface 90 containing at least one and in selected configurations a set of recoil grooves 92 spans the two sidewalls 86 and 88.

The adapter receptor 81 is configured or is adaptable to cooperatively engage the device mounting rail of the small arm dischargeable device 10. The adapter receptor 81 includes a pair of sidewalls 94 and 96 having a V-shaped configuration for receiving mating sidewalls of a primary mounting rail (not shown), such as may be formed integrally with or as an attachment to a small-arm dischargeable device. Clamps, including setscrews or other fastening structures, can be incorporated into the receptor 81 for securing the adapter 80 to a primary mounting rail.

The adapter receptor 81 can be defined the pair of opposing fixed sidewalls 94, 96. In selected constructions, the adapter receptor 81 is partially defined by a closed end 95 which is bounded by the sidewalls 94, 96. In this construction, the closed end 95 is a portion of the adapter body 75.

Figure 11:
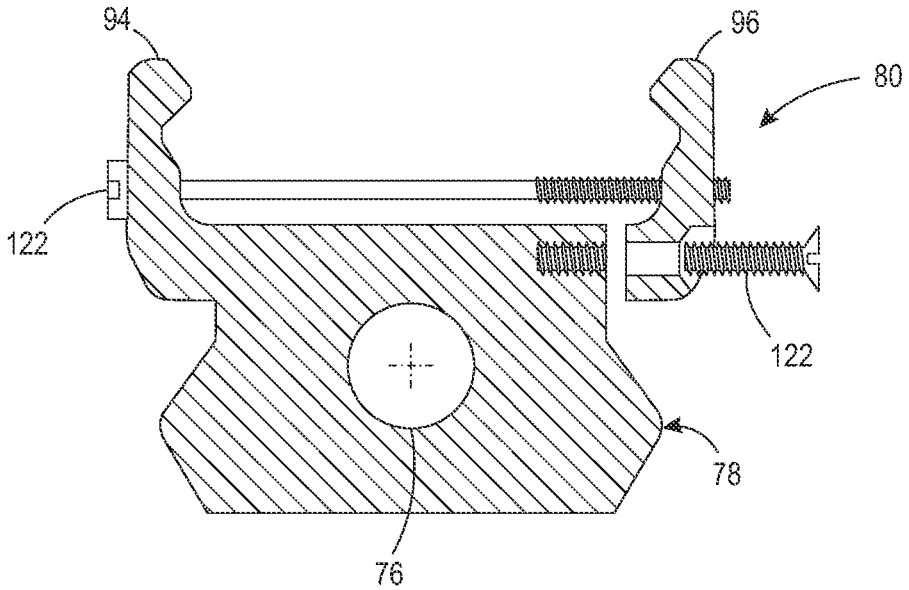
FIG. 11 is a cross sectional end view showing one of the adapter receptor walls being removable.
Figure 12:
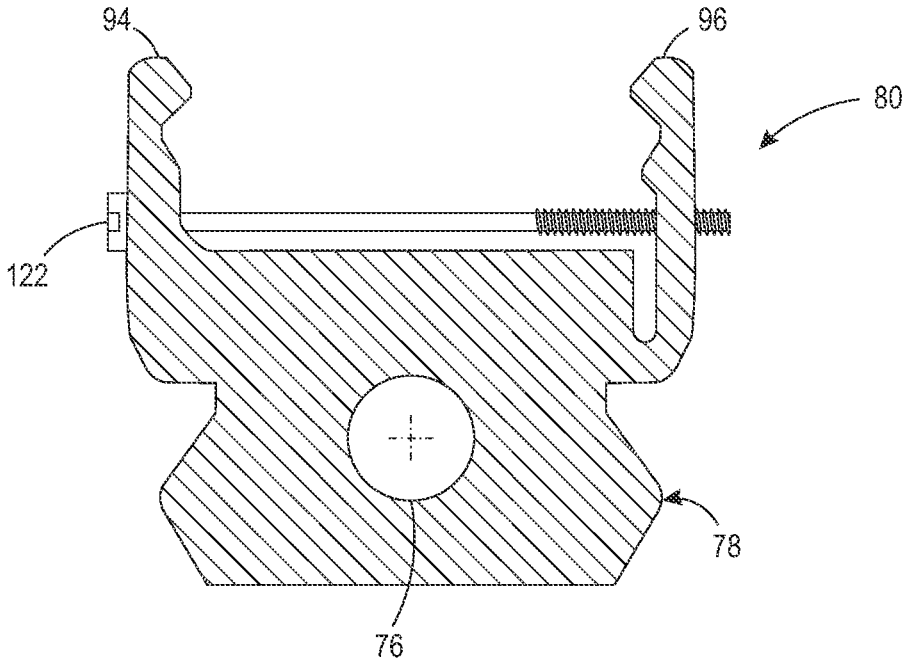
FIG. 12 is a cross sectional end view showing one of the adapter receptor walls being movable.

With respect to the sidewalls, one or both of the sidewalls can be movable or pivot relative to the adapter body 75. As seen in FIGS. 11 and 12, one of the sidewalls 94 of the adapter receptor 81 is fixed and the opposing sidewall 96 is moveable. Referring to FIG. 12, movement relative to the adapter body 75 can be provided by a hinge 120 between the sidewall and the adapter body, such as a living hinge. Thus, at least the portion of the adapter body 75 including the side wall 96 and the hinge 120 can be injection molded from a variety of polymers and compounds as known in the art. As seen in FIG. 11, it is also contemplated the sidewall 96 can be removable from the adapter body 75 and the relative movement provided by the adapter body and the moving sidewall having cooperating friction engagement, such as a loose fitting tongue and groove. Play between the moveable sidewall and the adapter body 75 is taken up by securing the adapter 80 to the primary mounting rail. It is also understood the relative motion can be taken up by securing engaging the sidewall 96 to at least one, and in selected configurations a combination of one of the remaining sidewall 94, the adapter body 75 and the small arm 10, such as by threaded fasteners 122 or cams.

Figure 13:
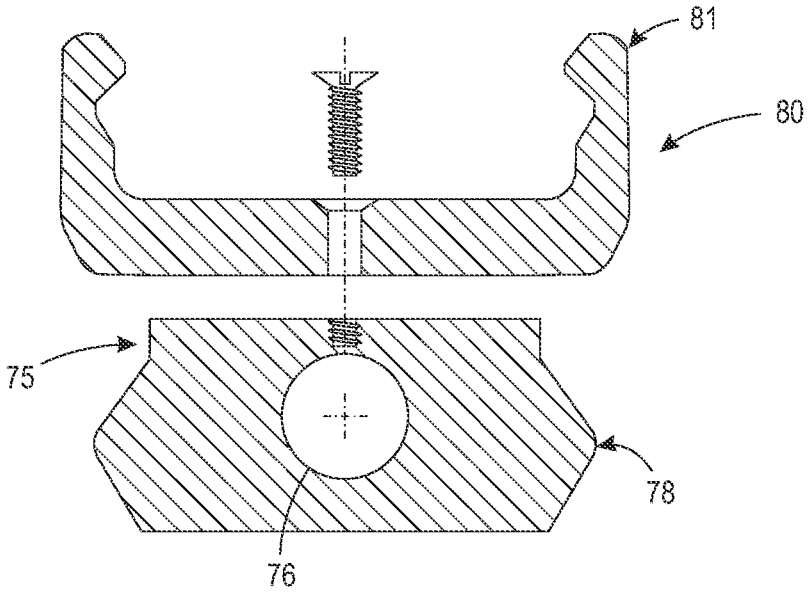
FIG. 13 is a cross sectional end view showing the adapter receptor being removable from the adapter body and the adapter mounting rail.

Referring to FIG. 13, the adapter receptor 81, or at least a portion of the adapter receptor, can be releasably connected to the adapter body 75. In one configuration, the entire adapter receptor 81 is releasably connected to the adapter body. Alternatively, a portion of the adapter receptor 81, such as a sidewall 96 can be releasably connected to the adapter body 75.

Alternatively, the adapter receptor 81 could be arranged as a clamp for engaging other components of the small-arm discharge device, such as a barrel, ordinarily not intended for mounting accessories. The adapter receptor 81 could also be formed integrally with the receiver or frame of small arm discharge devices and the mounting rail of such an integral structure could be modified to incorporate, in addition to laser sights, battery compartments or switches for operating the laser sights. Conversely, adapters 80 with adapter mounting rails 78 modified to incorporate laser sights can be electrically coupled to the small-arm discharge devices or to accessories of the small-arm discharge devices to obtain power or switch control.

The adapter mounting rail 78 defines a dovetail and is distanced from the adapter body by a spacer 82, wherein each of the dovetail and the spacer define corresponding cross sectional areas transverse to the axis of the adapter mounting rail.

For example, the adapter mounting rail 78 has a generally T-shaped dovetail profile with the spacer 82 acting as a pedestal supporting the overhanging dovetail 84. The adapter mounting rail 78 includes sidewalls 86 and 88 having compound surfaces with opposing V-shapes for engaging similarly shaped sidewalls in an accessory receptor (not shown). An outer land surface 90 of the adapter mounting rail contains at least one and in select configurations a set of recoil grooves 92 spanning the two sidewalls 86 and 88.

Figure 14:
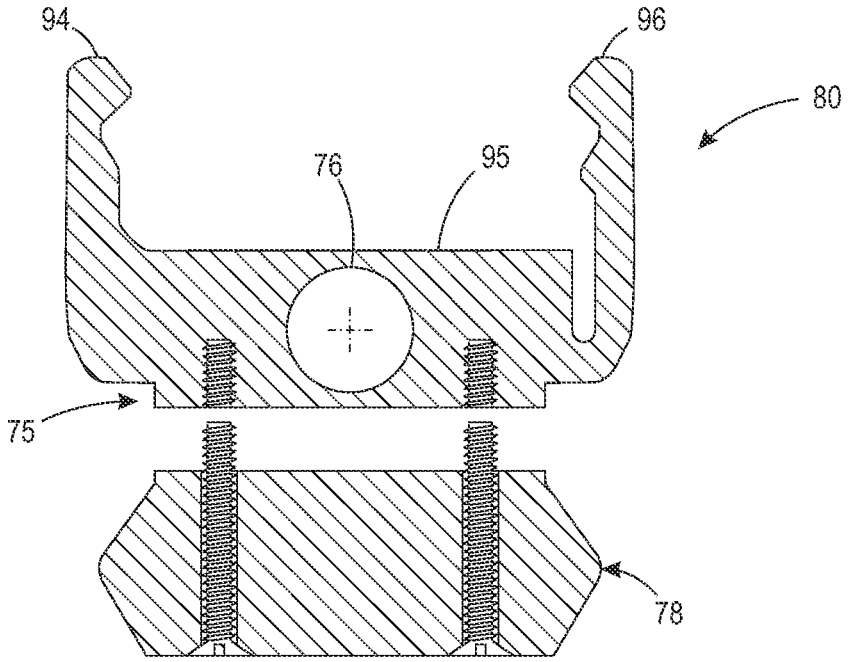
FIG. 14 is a cross sectional end view showing the adapter mounting rail being removable from the adapter body and the adapter receptor.
Figure 15:
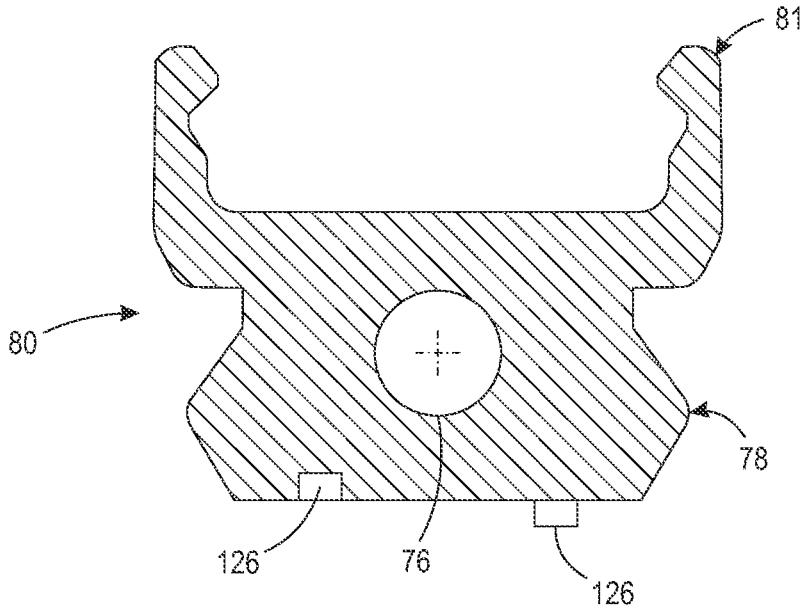
FIG. 15 is a cross sectional end view showing the adapter mounting rail including electrical contacts.
Figure 16:
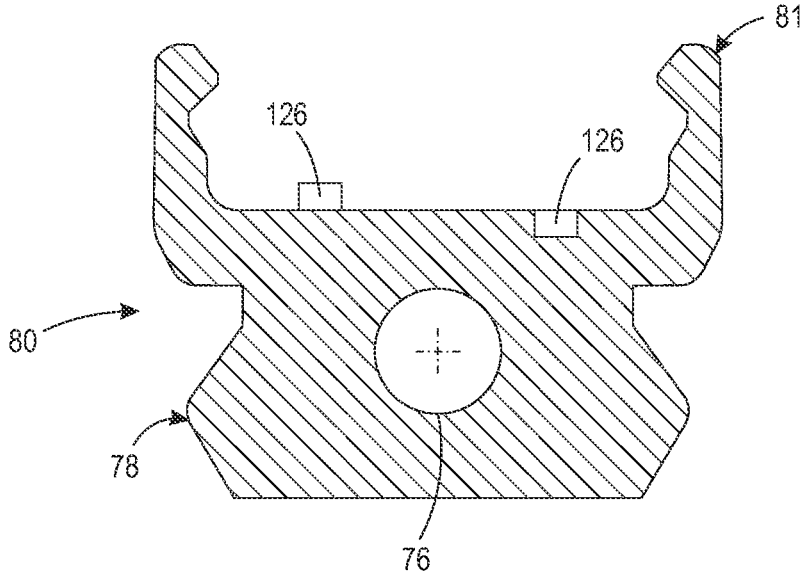
FIG. 16 is a cross sectional end view showing the adapter receptor including electrical contacts.
Figure 17:
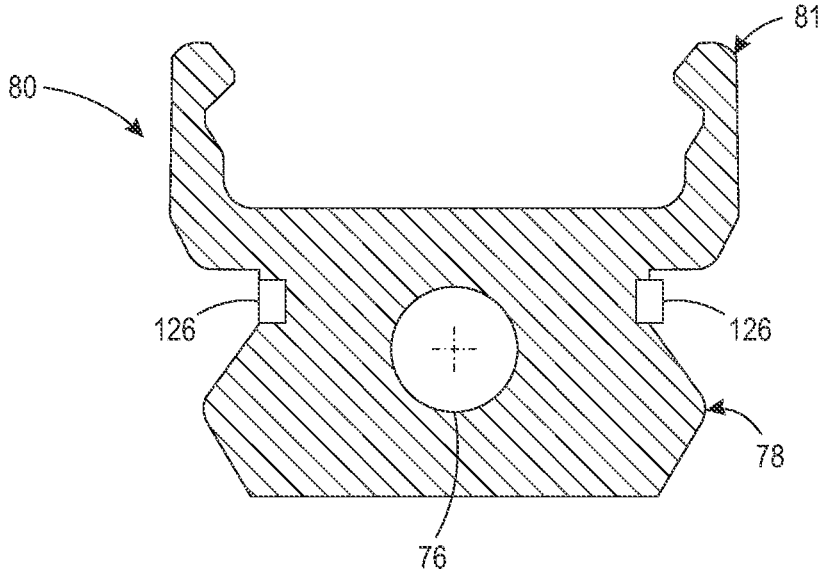
FIG. 17 is a cross sectional end view showing the spacer in the adapter body including electrical contacts.
Figure 18:
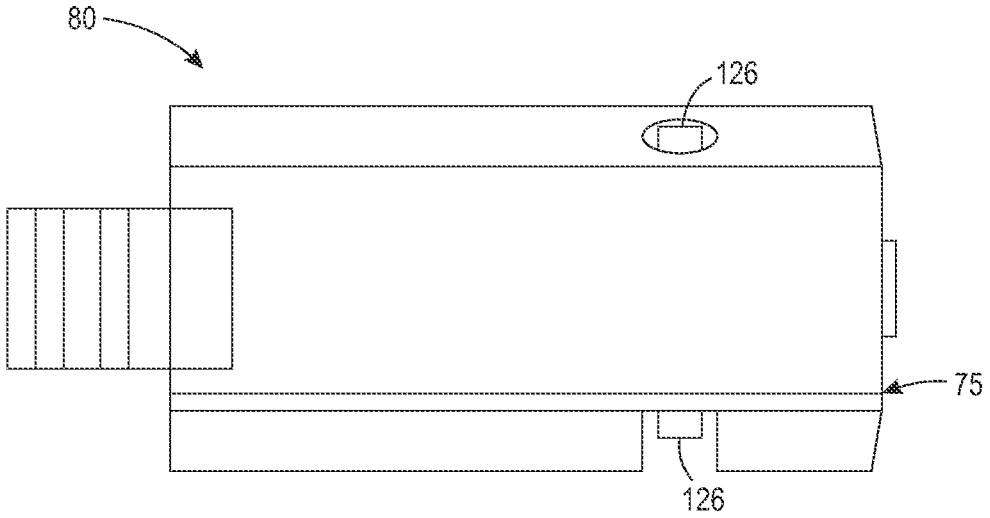
FIG. 18 is a top plan view showing an electrical contact in the adapter body.

In a further configuration, as seen in FIG. 14, the adapter mounting rail 78 can be a separately formed component and releasably connected to the adapter body 75, such as by threaded fasteners, cams, or clasps. Thus, adapter mounting rails having different cross sectional profiles can be readily employed with a given adapter body 75. In addition, the adapter mounting rail 78 can be formed of individual pieces which can be moved relative to each other thereby providing different cross sectional profiles. For example, the adapter mounting rail 78 can be generally split along the longitudinal axis, and the respective pieces moved towards or away from each other to vary the cross sectional profile of the adapter mounting rail.

Referring to FIGS. 15-18, at least one of the adapter mounting rail 78 and the adapter receptor 81 can include electrical contacts 126. The electrical contacts 126 can be in the form of exposed pads or contacts. Alternatively, the electrical contacts 126 can be configured as any of a variety of commercially available modular interconnected structures including serial or parallel ports such as USB, Firewire, and Micro-USB. It is understood the electrical contacts 126 include the interface to a secondary device as well as the electrical conductor within the adapter 80.

The electrical contacts 126 can be independent or elements of a common bus. In addition, the electrical contacts 126 can be cooperatively connected to a circuit board 130 in the adapter body 75 and thus form inputs and outputs to the circuit board. That is, the electrical contacts 126 can form pathways for signals to the adapter 80 and signals from the adapter to secondary engaged devices as well as the small arm dischargeable device 10.

The electrical contacts 126 can be exposed along the adapter mounting rail 78, such as along the compound surfaces or the land area. In additional configurations, the electrical contacts can be exposed along the spacer 82. The electrical contacts 126 can be exposed on the adapter body 75. In a further configuration, the electrical contacts 126 are exposed in the adapter receptor 81 such as along one of the sidewalls 94, 96 or the closed end of the adapter receptor. Location within the adapter receptor 81 allows the electrical contacts to interface with electrical contacts associated with the primary rail mount. For example, while the small arm dischargeable device 10 includes control electronics such as communications transceivers or even a power supply, then the electrical contacts of the adapter 80 can communicate with such electrical components of the small arm dischargeable device.

Further, as the electrical contacts 126 may be operably connected to the driver circuit, the RF transmitter, an RF receiver, GPS receiver, a video signal receiver, an IFF transmitter or an IFF receiver, the electrical contacts can transmit (send, receive or both) power and/or communication signals to and from the adapter to a separate device.

The electrical contacts 126 can be separate components affixed to the adapter or can be integrally molded or formed into the adapter.

Figure 19:
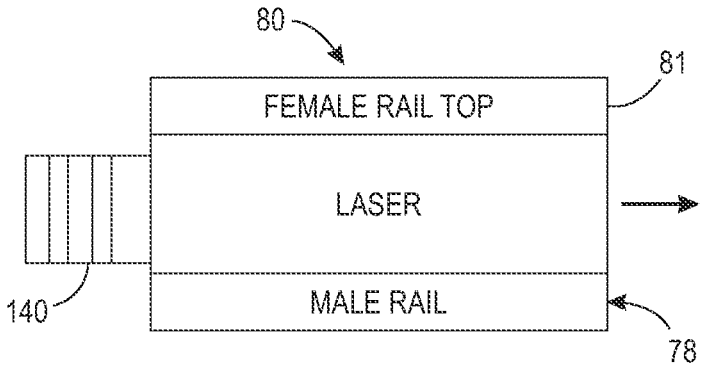
FIG. 19 is a schematic representation of a flex switch cooperatively engaged with the adapter.
Figure 20:
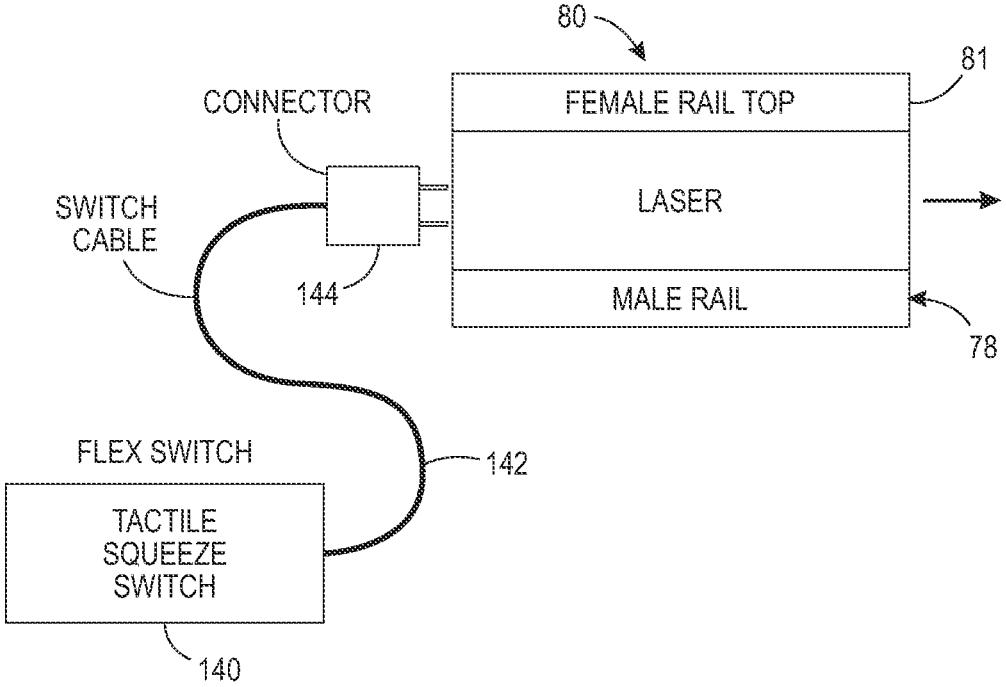
FIG. 20 is a schematic representation of a flex switch cooperatively engaged with the adapter by a cable such that the flex switch is spaced from the adapter.
Figure 21:
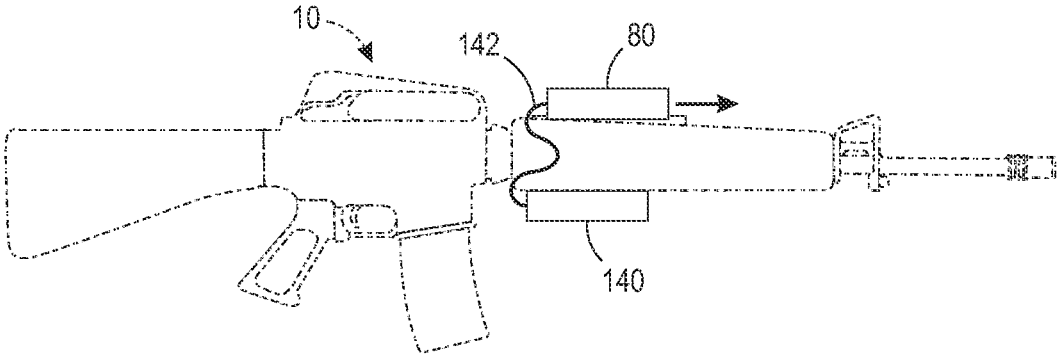
FIG. 21 is a schematic representation of a flex switch cooperatively engaged with the adapter by a cable such that the flex switch is spaced from the adapter and mounted on a remote portion of the dischargeable device.

In a further configuration shown in FIG. 19, a flex or ribbon switch 140 can be operably located on an exposed surface of the adapter 80. The flex switch 140 can be any commercially available device such as sold by Tapeswitch Corporation of Farmingdale, N.Y. The flex switch 140 can be operably connected to any of the electrical components of the adapter 80. It is further contemplated, as seen in FIG. 20, that the flex switch 140 can be connected to an electrical conductor 142 so that the switch can be spaced from the adapter 80, and thus operably located on a surface of the small arm dischargeable device as seen in FIG. 21. In one configuration shown in FIG. 20, the toggle switch 74 can be a modular construction such that upon unplugging the switch 74, the associated connector of the flex switch 140 can be plugged into the adapter.

Depending upon the intended operating characteristics, the spacer 82 can locate the overhanging adapter mounting rail 78 relatively adjacent to or spaced from the adapter body 75. That is, the spacer 82 can locate the adapter mounting rail a minimum operational distance from the adapter body 75, or a given greater distance from the adapter body. The spacer 82 can be formed by generally parallel, diverging or converging walls. As seen in FIGS. 7-10, the walls are generally parallel.

The adapter 80 includes a beam generator such as a laser sight 76. The beam generator can selected to produce any of a variety of wavelengths, wherein the wavelengths may or may not be coherent as in a laser. However, for purposes of description, the laser sight 76 can be located within or at least partially within the cross sectional area of one of the adapter body 75, the adapter receptor 81 and the adapter mounting rail 78. An optical axis of the laser sight 76 is substantially aligned with a longitudinal axis 100 of the adapter mounting rail 78, but is preferably adjustable for calibrating the laser sight.

A typical laser sight 76 for purposes of the present system includes a laser diode and a collimating lens aligned along a common optical axis within a common housing. Additional components can also be included within the housing including control circuitry (not shown) for cycling the laser diode on and off to save power and adjustment features for the collimating lens for aligning the laser sight as desired. The batteries provide an onboard power supply to the laser diode through a circuit interrupted by a switch. The power supply, which is preferably in the form of one or more batteries, can be located within an extension of the adapter 80 or can be located elsewhere in the adapter or within the small arm discharge device 10, such as within the grip of a firearm and connected by electrical contact as set forth herein. The switch can also be mounted in the adapter 80 or elsewhere in the small-arm dischargeable device in cooperation with the electrical contacts 126. A more detailed example of a laser sight that can be assembled within a common housing is described in my U.S. Pat. No. 5,509,226, which is hereby incorporated by reference.

Figure 22:
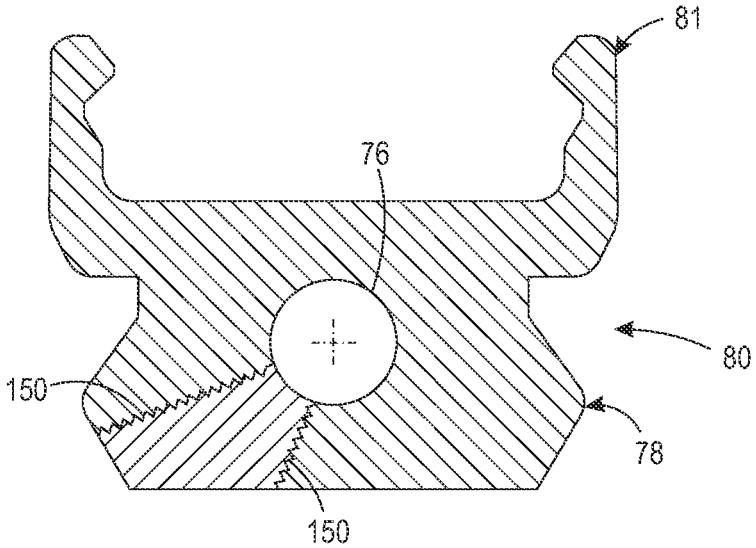
FIG. 22 is a schematic representation of an adjusting mechanism for aligning the axis of the laser with respect to the adapter.
Figure 23:
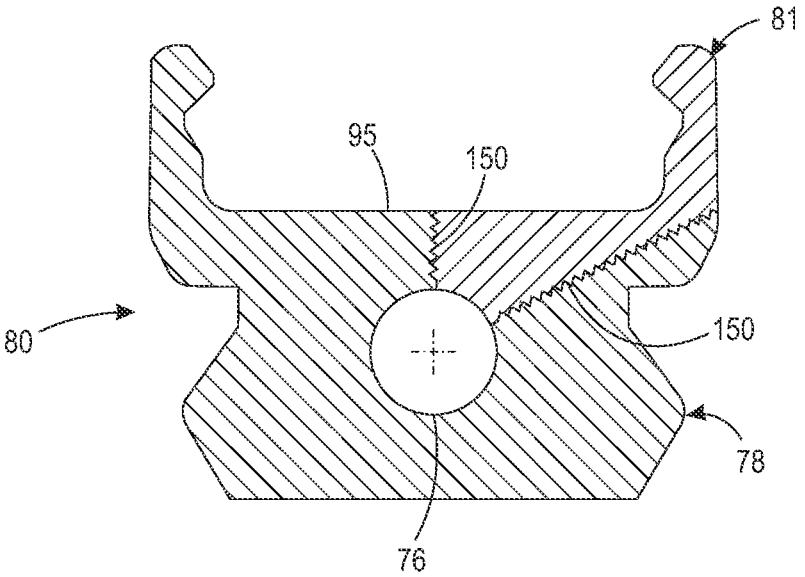
FIG. 23 is a schematic representation of an alternative location of the adjusting mechanism for aligning the axis of the laser with respect to the adapter.
Figure 24:
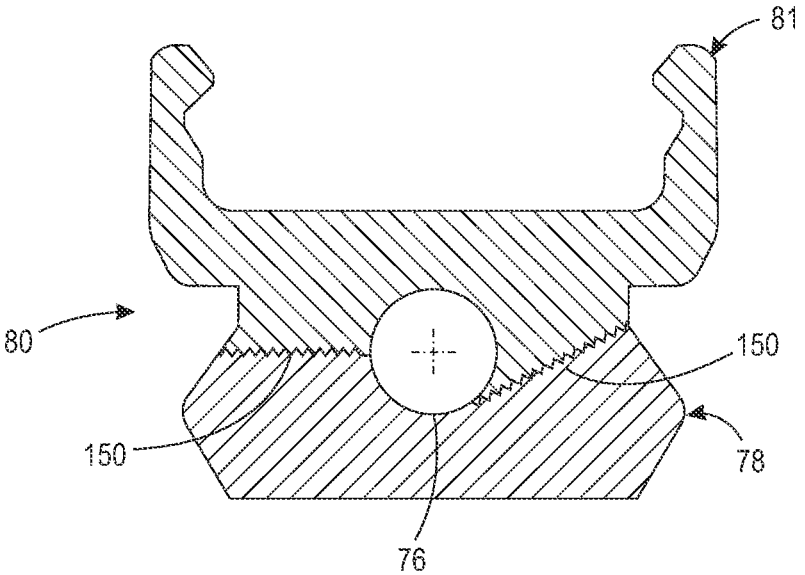
FIG. 24 is a schematic representation of a further alternative location of the adjusting mechanism for aligning the axis of the laser with respect to the adapter.

The adjustment of the optical axis relative to the adapter 80 and hence the small arm dischargeable device 10 can be accomplished by the use of adjustment screws or cams 150 acting on the laser. The adjustment screws or cams 150 impartment movement of the laser sight relative to the adapter body. Referring to FIGS. 22-24, the adjustment screws or cams 150 can be located in and thus exposed through the adapter mounting rail 78, such as though the land area, a recoil groove, the dovetail or the spacer 82. It is contemplated the adjustment screws or cams 150 can be located in any combination of the land area, a recoil groove, the dovetail or the spacer 82 of the receptor mounting rail 78.

Alternatively, or additionally the adjustment screws or cams 150 can be located the adapter receptor 81 and thus exposed through at least one of the sidewalls 94, 96, the fixed wall, the moveable wall, as well as the closed end 95 of the receptor. It is contemplated the adjustment screws or cams 150 can be located in any combination of the sidewalls, the fixed wall, the moveable wall, as well as the closed end of the receptor 81.

The laser sight 76 can be selected to emit electromagnetic radiation in one of the UV, visible, near IR, SWIR, mid-IR, long IR or terahertz portion of the electromagnetic spectrum. These lasers are commercially available and can be incorporated into the adapter.

Figure 25:
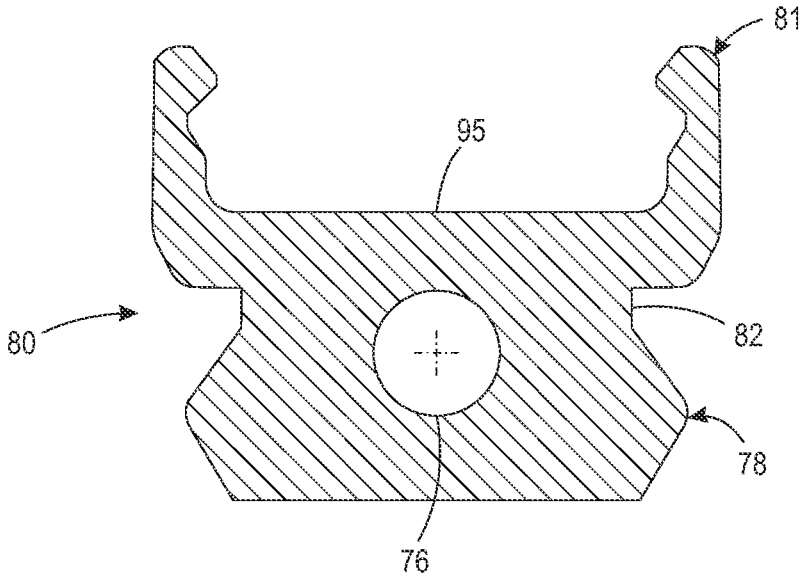
FIG. 25 is a cross sectional view of the adapter showing a location of the laser sight.
Figure 26:
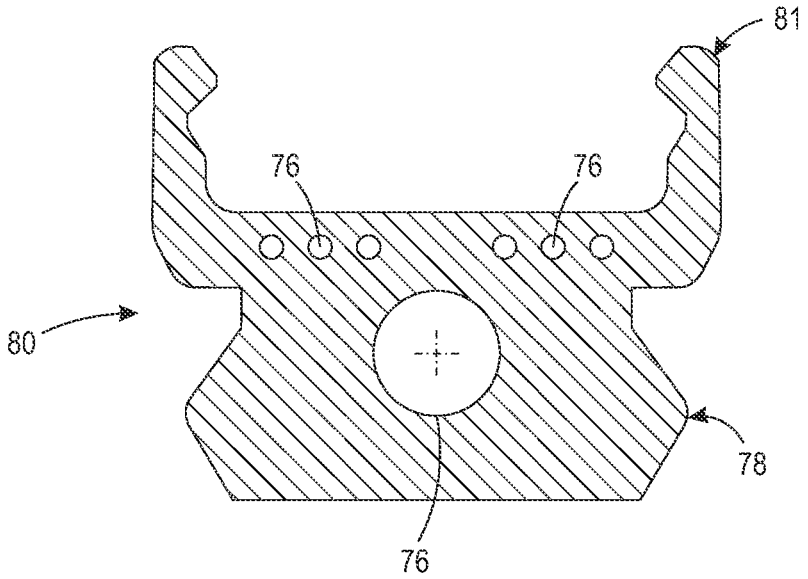
FIG. 26 is a cross sectional view of the adapter showing an alternative location of the laser sight.
Figure 27:
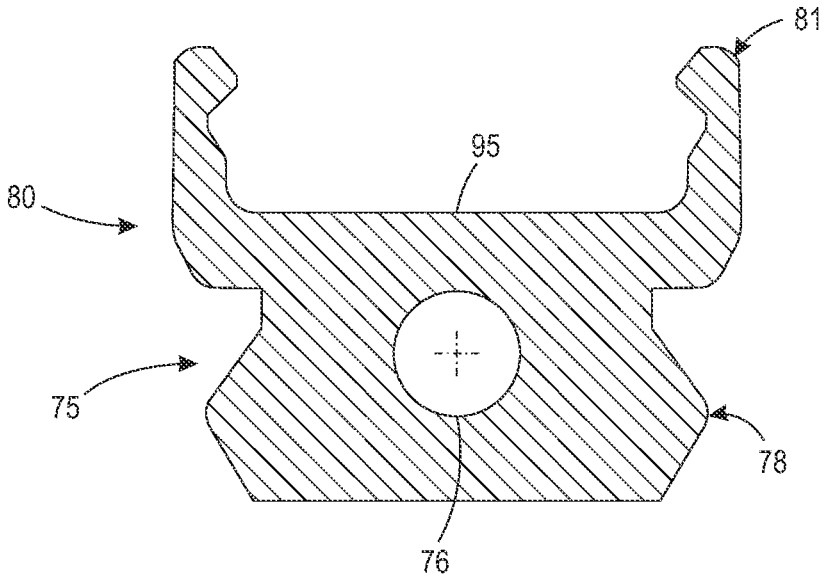
FIG. 27 is a cross sectional view of the adapter showing a further alternative location of the laser sight.

As seen in FIGS. 25-27, the laser sight 76 can be located within the cross sectional area of the adapter body 75, the adapter mounting rail 78, the spacer 82, the adapter receptor 81 or the spacer and the adapter mounting rail 78 or the receptor. That is, at least a portion of the laser sight 76 can be disposed within the cross sectional area of at least one of the adapter body 75, the adapter mounting rail 78 and the adapter receptor 81. As seen in the Figures, the laser sight 76 can be located within the cross sectional area of the spacer. Referring to FIG. 26, it is contemplated that a plurality of miniaturized LED lights or lasers can be disposed along a portion of any of the adapter receptor 81, the spacer 82 or the adapter mounting rail 78.

Further, the laser sight can be centrally located within the cross section (laterally or vertically). Alternatively, the laser sight 76 can be offset from a line of symmetry of the adapter 80.

Figure 28:
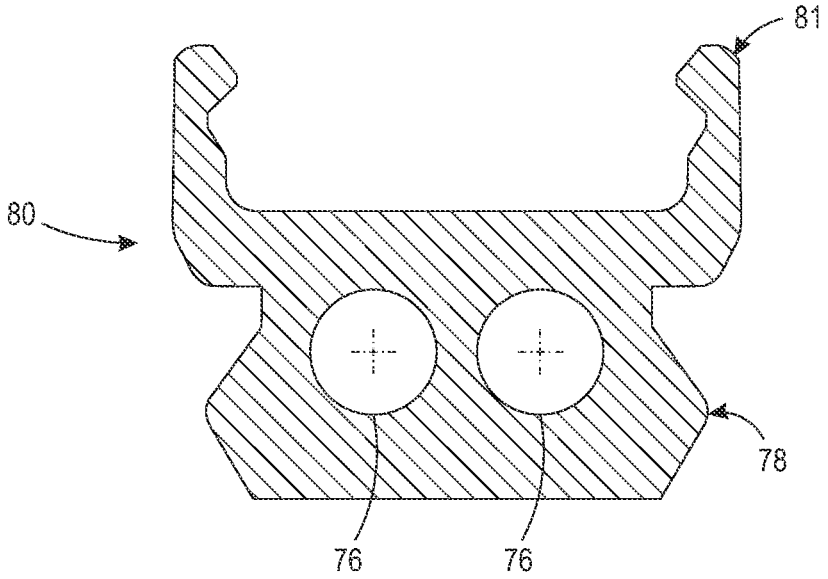
FIG. 28 is a cross sectional view of the adapter showing an additional beam emitter such as an LED light.

As seen in FIGS. 26 and 28, the adapter 80 can further include additional beam generators such as LEDs for creating an illuminating beam. Thus, the adapter 80 can include a plurality of beam generators, wherein the beam generators are of the same (coherent) or different types.

A battery compartment 104 is formed in the adapter, such as in the adapter mounting rail 78 through the outer land surface 90. Two button-type batteries 106 and 108 are shown within the battery compartment 104 for powering the laser sight 76. A slide-on cover 110 for the battery compartment 104 forms a part of the outer land surface 90.

Figure 29:
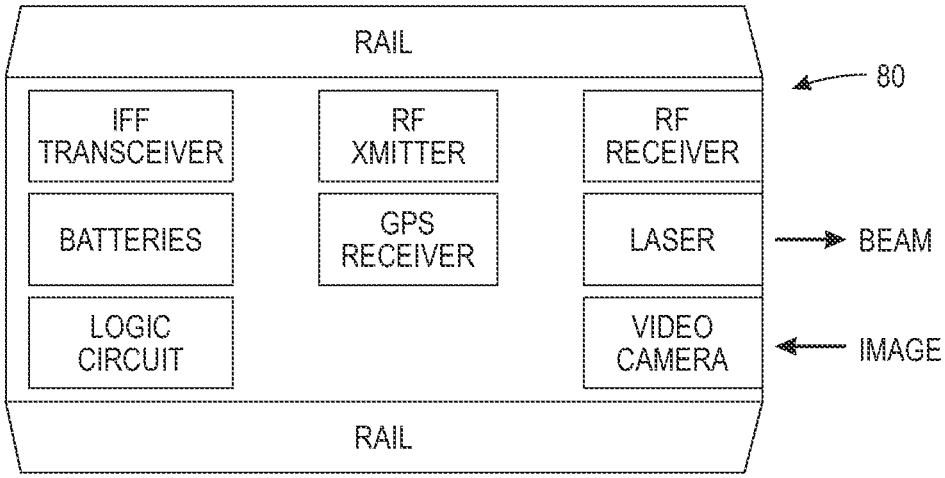
FIG. 29 is a schematic representation of additional components housed within the adapter.

Referring to FIG. 29, in addition to the laser sight 76, the adapter 80 can house at least one of an RF transmitter, an RF receiver, GPS receiver, a video signal receiver, an IFF transmitter, an IFF receiver. It is understood the RF transmitter and RF receiver can be incorporated into a single RF transceiver, such as commercially manufactured by Atmel and Texas Instruments. Similarly, the IFF transmitter and IFF receiver can be incorporated into a single IFF transceiver, such as the Dallas Semiconductor/Maxim DS2432 or Spartan-3 generation series with Xilinx Virtex encryption, or Raytheon AN/APX-100. The GPS receiver can be a commercially available unit such as Navilink 4.0 GPS 5300 by Texas Instruments. The video signal receiver can include commercially available units such as the XC3028, a silicon-germanium (SiGe) BiCMOS single chip tuner by XCEIVE Corp. of Santa Clara, Calif.

Figure 30:
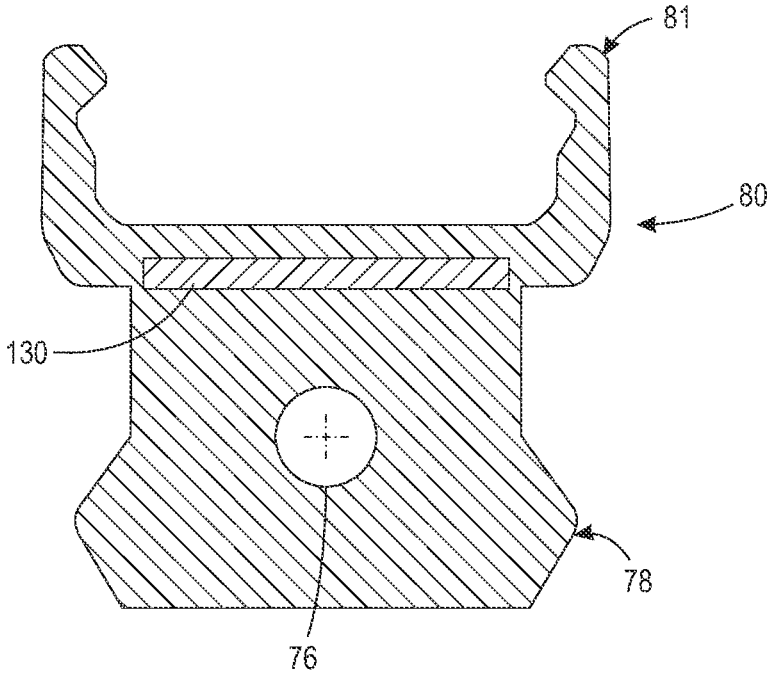
FIG. 30 is a cross sectional view of the adapter showing a first location of a circuit board.
Figure 31:
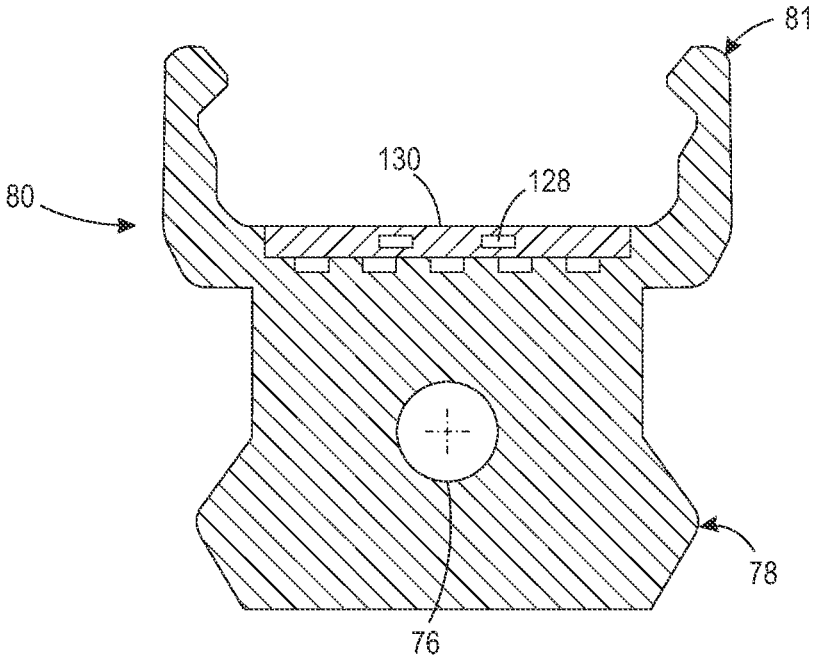
FIG. 31 is a cross sectional view of the adapter showing a second location of a circuit board.
Figure 32:
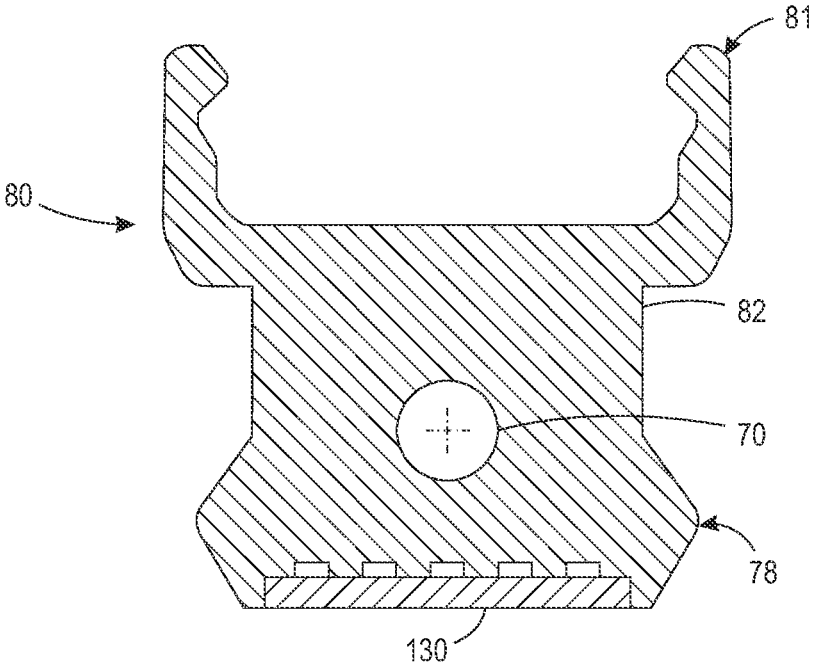
FIG. 32 is a cross sectional view of the adapter showing a third location of a circuit board.

As seen in FIGS. 30-32, the adapter 80 can also include a circuit board 130, such as a printed circuit board or a formed board or wafer having a driver circuit for control of the electrical components associated with the adapter, such as the laser. The circuit board 130 can be located within the adapter body 75. Alternatively, at least a portion of the circuit board 130 can be located to form an exposed surface of a portion of the adapter body, the adapter mounting rail 78 or the adapter receptor 81. That is, the circuit board 130 can include a layer or surfacing, such as a polymeric coating providing sufficient resistance to function as an exposed surface of the adapter 80. The circuit board 130 can include a switch, such as a toggle or button switch which can be accessed by the operator upon engagement of the adapter 80 with the primary mount.

A toggle switch 112 is formed through the adapter mounting rail 78, particularly within the spacer for electrically connecting and disconnecting the laser sight 76 to the batteries 106 and 108. The toggle switch 112 has a switch arm 114 that is translatable between middle position at which the laser sight 76 is disconnected and either of two end positions at which the laser sight 76 is connected for powering the laser sight. Knobs 116 and 118 at opposite ends of the arm 114 provide handles for manually translating the switch and also provide stops for limiting the translation of the toggle switch 112 to between the off and on positions.

Thus, in addition to locating or embedding the laser sight 76 in the adapter mounting rail 78 of the adapter 80, the battery compartment 104 is formed in the adapter mounting rail 78 for powering the laser sight 76 and a switch 112 is formed through the mounting rail 78 for turning the laser sight 76 both on and off. Together, the laser sight 76, battery compartment 104, and the switch 112 form an entirely self-contained laser module within space otherwise occupied by the adapter mounting rail and/or the spacer of the adapter 80, which can be transferred by way of the adapter receptor 81 between small-arm discharge devices.

The adapter receptor 81 can be arranged as a mate to the adapter mounting rail 78, such as by forming both the adapter receptor 81 and the adapter mounting rail 78 according to a common specification, such as Weaver or Picatinny specifications. It is also contemplated the adapter receptor 81 can be arrange to mate with a different style mounting rail so that the adapter mounting rail 78 projecting from the adapter 80 is different from the primary mounting rail intended for engagement by the adapter receptor 81 formed within the adapter 80. In addition to presenting a different choice of mounting rail for attaching accessories, the adapter 80 can be used as a riser for deliberately offsetting other accessories. Either way, the laser sight 76 can be embedded in the adapter mounting rail in a protected fashion without requiring additional space beyond the space otherwise required for carrying out the remaining functions of the adapter.

Further, it is understood the adapter 80 can include any subset of the disclosed components, and thus can be constructed without the laser sight 76, while retaining any one of the GPS, IFF or video components. It is also contemplated the adapter 80 can include a non-coherent illuminating LED in the place of the laser sight, without departing from the scope of the disclosure.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. In a Picatinny rail arranged for mounting accessories to a small-arm dischargeable device and having a T-shaped profile for engaging corresponding features of the accessories; the improvement comprising:

a laser sight that is at least partially embedded in a portion of the Picatinny rail having the T-shaped profile in which the T-shaped profile of the Picatinny rail includes a pedestal supporting an overhanging platform having relatively inclined sidewalls for engaging the accessories, in which the T-shaped profile extends along a longitudinal axis of the Picatinny rail, the laser sight emits a collimated beam of light along an optical axis, and the optical axis of the laser sight is substantially aligned with the longitudinal axis of the Picatinny rail within the T-shaped profile of the Picatinny rail and in which a battery compartment is formed in the overhanging platform through an outer land surface that extends between the relatively inclined sidewalls of the platform.

2. In a Picatinny rail arranged for mounting accessories to a small-arm dischargeable device and having a T-shaped profile for engaging corresponding features of the accessories; the improvement comprising:

a laser sight that is at least partially embedded in a portion of the Picatinny rail having the T-shaped profile;

in which the T-shaped profile of the Picatinny rail includes a pedestal supporting an overhanging platform having relatively inclined sidewalls for engaging the accessories, in which the T-shaped profile extends along a longitudinal axis of the Picatinny rail, the laser sight emits a collimated beam of light along an optical axis, and the optical axis of the laser sight is substantially aligned with the longitudinal axis of the Picatinny rail within the T-shaped profile of the Picatinny rail, in which a battery compartment is formed in the overhanging platform through an outer land surface that extends between the relatively inclined sidewalls of the platform and in which a repositionable cover for the battery compartment forms a portion of the outer land surface.

* * * * *